US008087396B2

(12) United States Patent
Hou

(10) Patent No.: US 8,087,396 B2
(45) Date of Patent: Jan. 3, 2012

(54) UNIVERSAL ENERGY-SAVING SYSTEM FOR MULTIPLE WORKING CONDITIONS

(76) Inventor: He Hou, Hebei (CN)

( * ) Notice: Subject to any disclaimer, the term of this patent is extended or adjusted under 35 U.S.C. 154(b) by 0 days.

(21) Appl. No.: 13/017,240

(22) Filed: Jan. 31, 2011

(65) Prior Publication Data

US 2011/0120422 A1 May 26, 2011

Related U.S. Application Data

(63) Continuation of application No. PCT/CN2009/073022, filed on Jul. 31, 2009.

(30) Foreign Application Priority Data

Jul. 31, 2008 (CN) ..... 2008 1 0134810

(51) Int. Cl.
*F02D 13/00* (2006.01)
*F02D 13/02* (2006.01)

(52) U.S. Cl. ..... 123/321

(58) Field of Classification Search ..... 123/321, 123/322, 325, 332, 493, 198 F, 90.15; 701/112
See application file for complete search history.

(56) References Cited

U.S. PATENT DOCUMENTS

| | | | | |
|---|---|---|---|---|
| 4,565,167 | A * | 1/1986 | Bryant | 123/70 R |
| 4,741,307 | A * | 5/1988 | Meneely | 123/321 |
| 4,932,372 | A * | 6/1990 | Meneely | 123/182.1 |

FOREIGN PATENT DOCUMENTS

| | | | |
|---|---|---|---|
| CN | 85200450 | U | 9/1985 |
| CN | 86209043 | U | 12/1987 |
| CN | 87103742 | A | 12/1988 |
| CN | 2156291 | Y | 2/1994 |
| CN | 2665379 | Y | 12/2004 |
| CN | 1800611 | A | 7/2006 |
| CN | 2813901 | Y | 9/2006 |
| CN | 201121543 | Y | 9/2008 |
| CN | 1963169 | B | 5/2010 |
| JP | 9053478 | A | 2/1997 |
| JP | 2006-037857 | A | 2/2006 |
| WO | 2007/032712 | A1 | 3/2007 |

OTHER PUBLICATIONS

International Search Report: PCT/CN2009/073022; mailed Nov. 12, 2009.

* cited by examiner

*Primary Examiner* — Mahmoud Gimie
(74) *Attorney, Agent, or Firm* — Ladas & Parry LLP

(57) ABSTRACT

A universal energy-saving system for multiple working conditions includes an electronic control unit and an actuator. The electronic control unit is adapted to sample, process running information of a vehicle and an instruction of a driver, control on and off of a fuel injector, and adapted to drive the actuator to lock or release an exhaust valve after opening the exhaust valve, so as to realize working under multiple working conditions. The features include: fuel of the engine is cut off when gliding, the exhaust valve is constantly half open, the engine races with reduced pressure; the inlet valve opens and closes normally, an inlet manifold is vacuum, direction and braking are not affected. When needing to do work or brake, the engine switches to the normal working condition automatically. Even if a fuel saving system fails, only the fuel saving function is lost, whereas other functions are normal.

10 Claims, 9 Drawing Sheets

Lubricating-oil tunnel of cam structure

UNIVERSAL ENERGY-SAVING SYSTEM FOR MULTIPLE WORKING CONDITIONS

FIELD OF THE TECHNOLOGY

The present invention relates to energy-saving techniques of vehicle engines, and more particularly, to a universal energy-saving system for multiple working conditions.

BACKGROUND OF THE INVENTION

As to existing four-stroke engines of vehicles, there are generally three working conditions during operation, respectively are: 1, working with full load; 2, gliding; 3, working with middle or little load. Among the three conditions, the first one is the most idealized, but does not occupy a large proportion. As to the second condition, when the vehicle needs no power during gliding, the engine not only does no work but does negative work, which wastes kinetic energy. The third condition has a low efficiency and wastes fuel (according to existing security performance of vehicles, gliding out of gear is prohibited).

Under the first idealized condition, when an existing four-stroke engine operates normally, there is only one stroke does positive work, whereas other three strokes create conditions for the stroke doing the work and do negative works.

Under the second condition, as shown in FIG. 1*a* to FIG. 1*d*, the four strokes of the engine are all doing negative work when the vehicle glides, especially for the compressing stroke shown in FIG. 1*b*. The reason is that, during the compression stroke, an inlet valve 101 and an exhaust valve 102 are both closed, the cylinder is obturated. Thus, a large retarding force is generated. Therefore, it can be seen that the retarding force generated by the compression stroke is the primary reason that the engine wastes kinetic energy and the vehicle does not glide far.

The third condition is easy to be understood and will not be described herein.

By referring to resources such as automobile techniques, automobile structures, Chinese patents CN85200450U, CN86209043U, 93200231.5 and CN87103742A, and by comparing with existing domestic and foreign techniques, it can be seen that prior art generally focuses on how to increase the efficiency of the engine but pays a little attention to how to reduce the waste of kinetic energy of the engine. For example, the variable valve timing technology proposed by Toyota is to make the inlet process more sufficient. The direct injection in the cylinder is to make the burning more complete and ideal. The variable compression ratio technique also belongs to this kind of technique. Although the cylinder closing and emission reduction technique of Mitsubishi can improve the efficiency but it does not decrease the retarding force of cylinder closing. According to the existed technology, the inlet valve and the exhaust valve are closed to reduce cylinder but the retarding force is not decreased. Also, the existed technology has the state that the inlet valve is closed and the exhaust valve is constant opened and has the state that the inlet valve is constant opened. Although it can reduce pressure but cannot ensure the vacuum of an inlet manifold and has deficiencies such as affecting braking of the original vehicle and has a complex structure.

SUMMARY OF THE INVENTION

In order to overcome the above deficiencies, embodiments of the present invention provide a universal energy-saving system for multiple working conditions, so as to control a working status of an engine according to different working conditions, which not only eliminates a retarding force under a gliding status, saves fuel and has a longest gliding distance, but also saves fuel of non-working cylinders and reduces load for a normal working cylinder, in a cruising state with reduced cylinders.

The technical solution provided by the embodiments of the present invention is as follows.

A universal energy-saving system for multiple working conditions, including: an electronic control unit, an actuator and an engine; in which the engine is a four-stroke engine with multiple cylinders and includes: cylinders, a piston, an inlet valve, an exhaust valve, a fuel injector, an inlet manifold, an exhaust manifold and an exhaust trunk;

the electronic control unit is adapted to drive the actuator to control the inlet valve and the exhaust valve of the engine to move according to a pre-defined circulation mode or a regular mode, and adapted to control on and off of a power supply of the fuel injector, so as to greatly reduce, when the vehicle glides and races with reduced pressure and no fuel, resistance of the engine to get a farthest gliding distance, and to use, when the vehicle operates with reduced cylinders, less fuel and has a smallest resistance of non-working cylinder, and to maintain power at a normal working condition, to achieve an objective of energy-saving and emission reduction;

the circulation mode includes: during four time periods of the crankshaft angle 0°-180°, 180°-360°, 360°-540° and 540°-720°, in each time period, there is an exhaust valve of each cylinder is at an open or part open state, the inlet valve only opens at an inlet stroke, the inlet valve only takes in air but not exhausts to make the inlet manifold vacuum, the exhaust valve both takes in air and exhausts, part of the air moves forward, or moves back to flow and exchange in the engine complementarily via the exhaust valve and the exhaust manifold with the intake and exhaust actions of each cylinder, remained air is directly emitted out from the exhaust trunk, to eliminate a compression stroke and an expansion stroke, to become a two-stroke procedure, and to eliminate a resistance when the engine races without fuel.

The actuator includes: a position limit apparatus which is able to restrict, under control of the electronic control unit, the exhaust valve of the engine of the vehicle at a regular movement state or at a non-close state;

at the non-close state, the exhaust valve moves according to a constant half open movement curve of the exhaust valve:

during the four time periods of the crankshaft angle 0°-180°, 180°-360°, 360°-540° and 540°-720°, the exhaust valve corresponding to the exhaust stroke moves to a largest lift from a constant half open state and then moves back to the constant half open state, exhaust valves corresponding to the intake stoke, the compression stoke and the expansion stroke keep in the constant half open state.

The universal energy-saving system further includes: an externally configured crankshaft angle sensor, stroke switches respectively installed under a speeding-up footplate, a braking footplate and a clutch footplate of the vehicle, a gliding switch, a cylinder reduction switch and a replace instruction switch installed on a steering wheel of the vehicle, and a working condition indication lamp configured on a dashboard;

the electronic control unit includes an electronic control board, input signals of the electronic control board include: a signal of the externally configured crankshaft angle sensor, a fuel injection signal and a low-speed signal of a vehicle ECU, speed-up signal, a braking signal and a clutch signal generated by stroke switches installed under the speeding-up footplate, the braking footplate and the clutch footplate, input signals of the gliding switch, the cylinder reduction switch and the replace instruction switch on the steering plate; and output signals of the electronic control board include: a control signal of the working condition indication lamp on the dashboard, and a fuel injection signal used for controlling the fuel injector of the vehicle.

The engine is a dual overhead camshaft engine;

the actuator includes a valve lever which is able to control the open and close degree of the exhaust valve under propping of a camshaft, in which the valve lever has a ring groove;

the position limit apparatus is a slider whose front end is able to insert into the ring groove;

the length of the ring groove equals to a sliding distance of the exhaust valve under the non-close state; and when the camshaft props up the valve lever to a largest lift, the slider is able to restrict, under control of the electronic control unit, the exhaust valve at the non-close state by inserting the front end into the ring groove.

The engine is a middle or low camshaft rocker arm valve engine;

the actuator includes a rocker arm which is able to control the open and close degree of the exhaust valve under the propping of a cam, in which the rocker arm includes a baffle;

the position limit apparatus is a slider whose front end is able to be extended to touch the baffle; and when the camshaft props up the valve lever to a largest lift, the slider is able to restrict, under control of the electronic control unit, the exhaust valve at the non-close state by touching the baffle and restricting movement of the rocker arm.

The engine is an overhead camshaft rocker arm engine;

the actuator includes a rocker arm which is able to control the open and close degree of the exhaust valve under the propping of a cam; a concentric ring configured at one side of the cam, and an active assistant arm configured on the rocker arm;

the radius of the concentric ring is larger than a basic ring of the cam but is smaller than a top outline of the cam, the active assistant arm is able to joint with the concentric ring;

the position limit apparatus is a limit pin which is able to restrict angel of the active assistant arm; and when the rocker arm opens the exhaust valve to the largest lift, the active assistant arm is able to restrict, under control of the electronic control unit, movement of the rocker arm by touching the concentric ring and the limit pin to restrict the exhaust valve at the non-close state.

The engine is a dual overhead camshaft engine;

the actuator includes a bracket fixedly installed between two adjacent cylinders of the engine, a swing arm rod combination hinged with the bracket, and a cam which controls the open and close degree of the exhaust valve by propping the valve lever;

the position limit apparatus is a position limit active cam installed at a non-camshaft seat side of the cam, in which the position limit active cam is hinged with the swing arm rod combination and cooperates with the cam by moving axis; and the position limit active cam is able to restrict, under control of the electronic control unit, the exhaust valve at the non-close state by propping up the valve lever.

The swing arm rod combination of two adjacent cylinders are both hinged with the bracket.

The position limit active cam includes two symmetrical components which mesh with each other by a mortise and tenon structure in an axis direction.

The open and close degree of the exhaust valve is configured in advance.

The universal energy-saving system for multiple working conditions does not affect normal operation of the engine, and is applicable for modification of vehicles with four-stroke engines using various kinds of fuels and having multiple cylinders, and is applicable for equipment of new vehicles with four-stroke engines using various kinds of fuels and having multiple cylinders.

The universal energy-saving system for multiple working conditions provided by the embodiments of the present invention only opens cylinder and reduces pressure to eliminate the retarding force, which does not waste fuel when racing and gliding (or for non-working cylinder when working at a cylinder reduction state). The engine can work discontinuously in a best performance field. Normal working of other components is not affected and the effect of fuel saving and emission reduction is dramatic. The system has a small volume and a low cost. It has a good compatibility with existing vehicles and is applicable for reconstruction of old vehicles and equipment of new vehicles. It has a high reliability and a wide application, and is applicable for equipment of vehicles with four-stroke engines using different kinds of fuels and having different numbers of cylinders, especially for mixed power automobiles. It is most applicable for vehicles with electromagnetic valve engines.

EMBODIMENTS OF THE INVENTION

The universal energy-saving system for multiple working conditions provided by embodiments of the present invention consists of two parts: an electronic control unit and an actuator. The electronic control unit is adapted to sample, convert and process relevant information such as speeding-up, braking, clutch, fuel injection, crankshaft angle, rotating speed of the vehicle and an instruction of a driver, and determine a working condition according to the relevant information so as to control the on and off of a fuel injector, and adapted to trigger the actuator to complete operations including locking or releasing an exhaust valve of the engine after opening the exhaust valve, so as to cut off fuel of a corresponding cylinder, make an inlet valve work normally and make the exhaust valve constant half open or constant half open at a compression stroke, an expansion stroke and an exhaust stroke, open cylinder and reduce pressure to eliminate a retarding force and let the engine racing; or put through the fuel injector to make it inject fuel normally, make the exhaust valve open and close normally and make the engine runs normally, so as to realize the operation of the engine on multiple working conditions.

In detailed embodiments of the present invention, a four-cylinder engine with an ignition order of 1-3-4-2 is taken as an example. But it is not restricted to four-cylinder engines. The constant half open in the embodiments of the present invention refers to any state between a non-close state and a full open state, but does not refer to a state that a half is constantly opened.

Figure 1A:
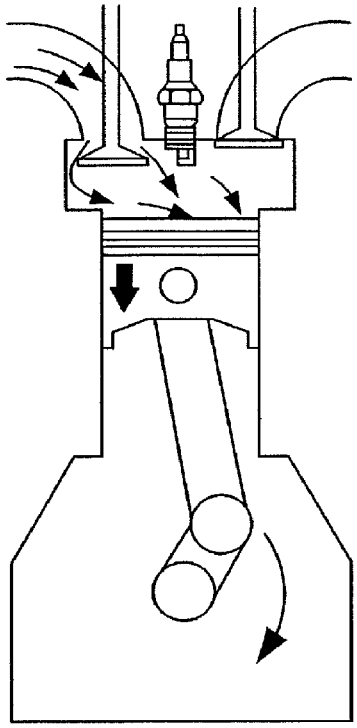
FIG. 1*a* to FIG. 1*d* are schematic diagrams illustrating circulation modes of an existing four-stroke engine.
Figure 1B:
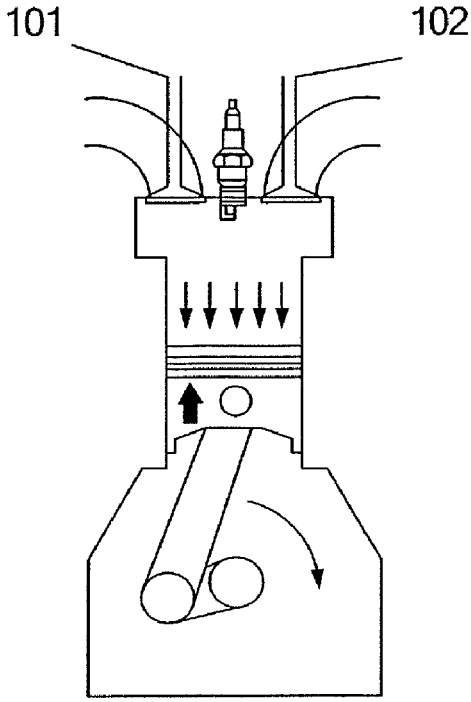
Figure 1C:
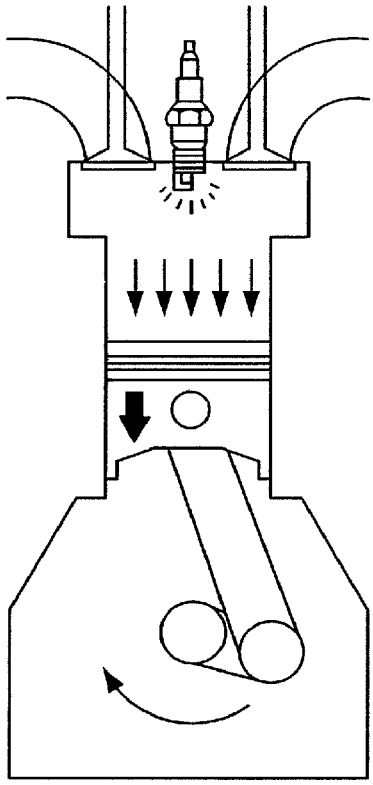
Figure 1D:
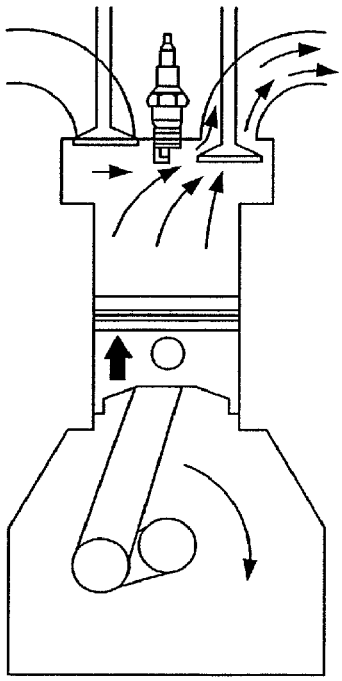
Figure 2:
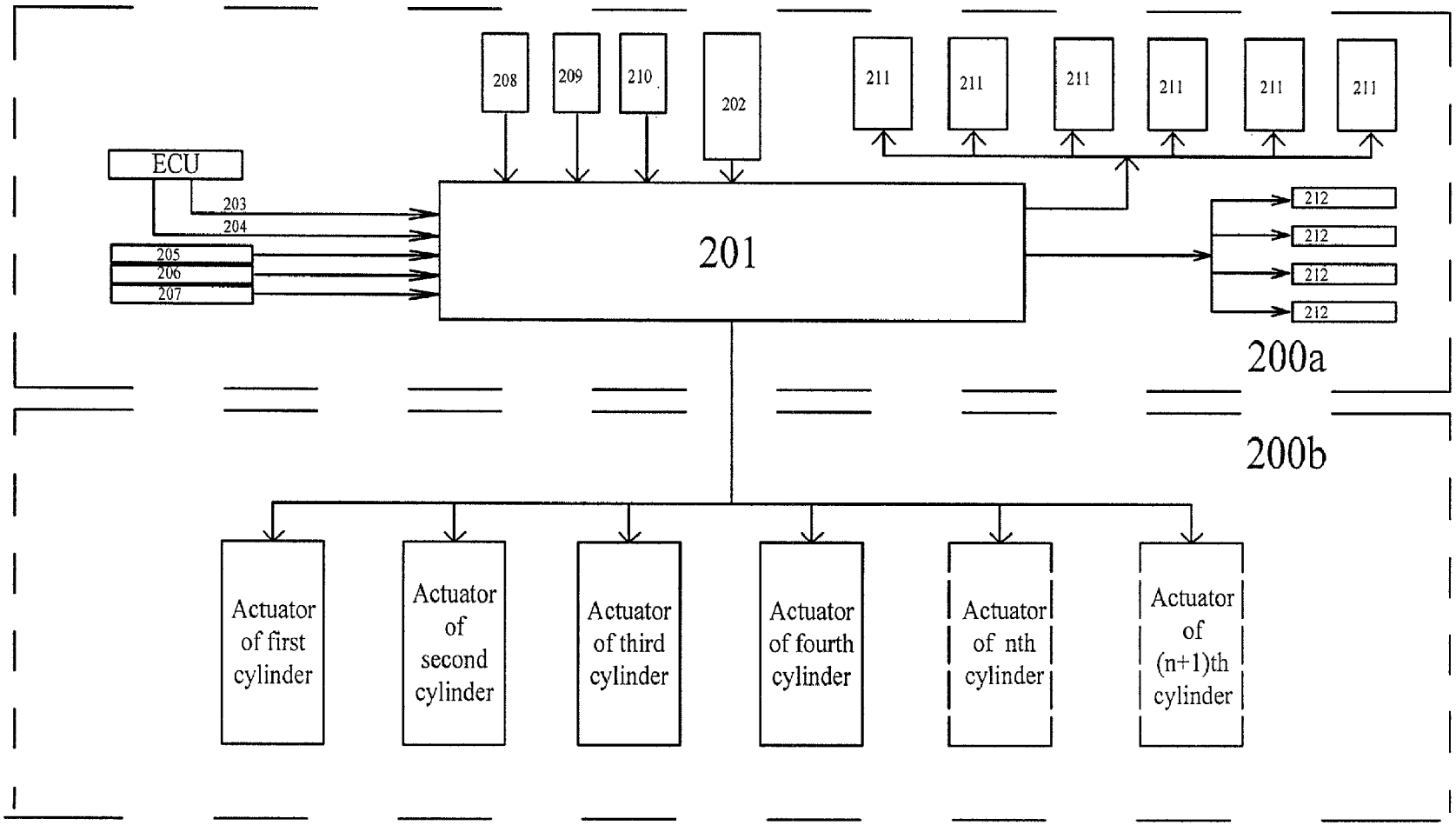
FIG. 2 is a block diagram illustrating a universal energy-saving system for multiple working conditions according to an embodiment of the present invention.

FIG. 2 is a block diagram illustrating a universal energy-saving system for multiple working conditions according to an embodiment of the present invention. As shown in FIG. 2, the electronic control unit 200*a* includes an electronic control board 201 (or a single-chip computer), signals inputted to the electronic control board 201 include: an externally configured crankshaft angle sensor (Hall sensor) 202; a fuel injection signal 203 and a low-speed signal 204 of an original vehicle ECU which is electronically coupled to the electronic control board via a connector; a speeding-up signal 205, a braking signal 206 and a clutch signal 207 respectively generated by stroke switches (magnetic sensitive switches or reed switches) installed under a speeding-up footplate, a braking footplate and a clutch footplate, input signals of three tact switches including a gliding switch 208, a cylinder reduction switch 209 and a replace instruction switch 210 installed on a steering wheel.

Signals outputted from the electronic control board 201 include: control signals of six working condition indication lamps (LED) 211 configured for controlling a dashboard and a fuel injection signal 212 used for controlling the fuel injector of the original vehicle. The electronic control unit 201 and the original vehicle ECU (electronic control unit) interlock the fuel injector in association. In addition, the electronic control board 201 is electronically coupled to a winding of an electromagnetic valve (or an electromagnet) of the actuator, so as to complete information sampling, converting and processing, control the on and off the fuel injector and drive the actuator 200*b*. The electronic control unit 200*a* may also consist of a single-chip computer and peripheral equipment or may be implemented by extending functions of the original vehicle ECU.

There are multiple technical solutions for implementing the actuator 200*b*. Hereinafter, four preferred technical solutions which are simple and require little modification to the original vehicle are introduced: 1, valve lever locking apparatus (FIG. 4); 2, rocker arm return restriction apparatus (FIG. 5); 3, rocker arm and active assistant arm apparatus (FIG. 6); 4, swing arm rod and activity limit cam (FIG. 8). These different structures have the same functions and can be used by engines with different valve trains and different remaining space, and can complete the operations including locking or releasing the exhaust valve after opening the exhaust valve in cooperation with the electronic control unit. The common feature of the four technical solutions is: if the exhaust valve is kept constant half open and locked, the exhaust valve is allowed to move from half open to full open at the same time, and the operation for locking or releasing the exhaust valve after opening the exhaust valve does not need to overcome a spring force of a valve spring, which saves power for locking, and is compatible with original exhaust structure and avoids the interference with the operation of the inlet valve. Detailed description will be given by following embodiments.

Figure 7:
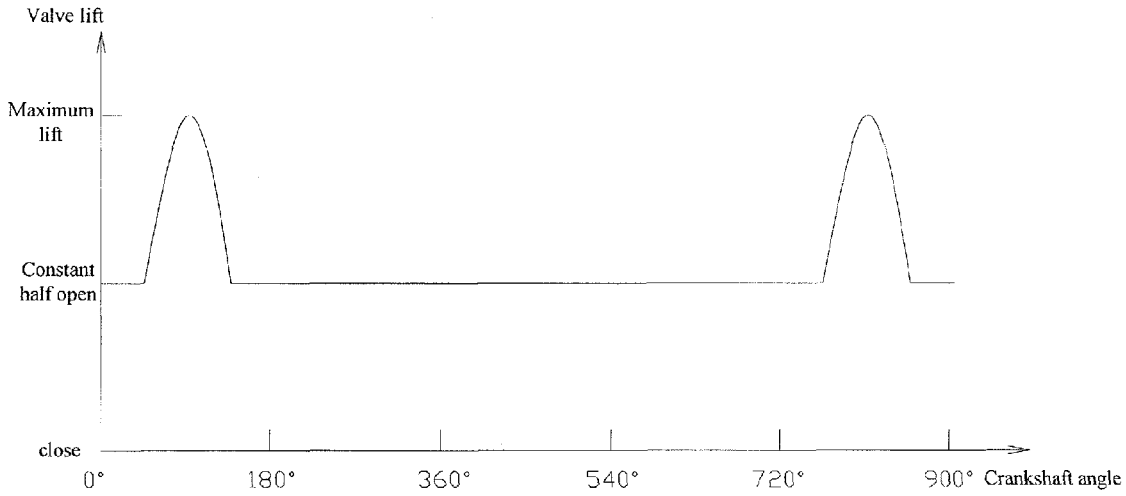
FIG. 7 is a curve illustrating a constant half open movement of an exhaust valve of the universal energy-saving system for multiple working conditions according to an embodiment of the present invention.

Through the above technical solution, a new circulation mode (FIG. 3) of the engine and a new movement curve of the exhaust valve (FIG. 7) under the working conditions b and c are realized. Now, the new circulation mode of the universal energy-saving system for multiple working conditions will be described with reference to FIG. 3*a* to FIG. 3*d*, in which the situation that a four stroke engine with the ignition order of 1-3-4-2 works under the racing working condition b when the crankshaft angle is 0°-180° is taken as an example.

Figure 3A:
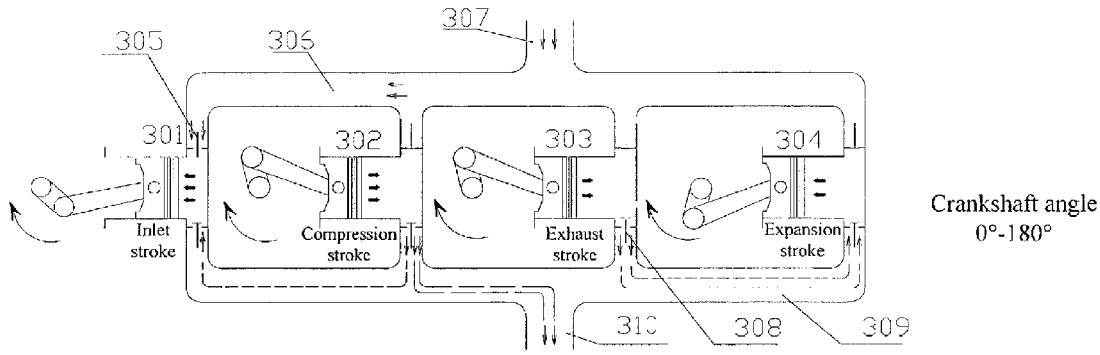
FIG. 3*a* to FIG. 3*d* are schematic diagrams illustrating circulation modes of the universal energy-saving system for multiple working conditions according to an embodiment of the present invention.

As shown in FIG. 3*a*, the first cylinder 301 is at an inlet stroke. An inlet valve 305 is open and an exhaust valve 308 is half open (or fully open). The piston moves left. The inlet valve 305 takes in a lot of new air via an inlet manifold 306. The exhaust valve 308 takes in a little amount of air emitted out by an adjacent cylinder via an exhaust manifold 309.

Certainly, the exhaust valve may also be closed during the inlet stroke. But this will make the actuator complex and increase the cost, whereas the actual effect has no big difference. Thus, its cost performance is low and it is not preferable. Since the circulation mode is the same, no description will be given herein.

The second cylinder 302 is at a compression stroke and is in an exhaust state at this time. The inlet valve 305 is closed and the exhaust valve 308 is half open (or fully open). The piston moves right. The air taken in during a previous circulation is emitted out via the half opened (or fully opened) exhaust valve 308 to the exhaust manifold 309 for the intake of an exhaust valve of the adjacent cylinder, or is emitted out via the exhaust trunk 310 directly.

The third cylinder 303 is at an exhaust stroke. The inlet valve 305 is closed and the exhaust valve 308 is fully open. The piston moves right. The air taken in during the previous circulation is emitted out via the fully opened exhaust valve 308 to the exhaust manifold 309 for the intake of the exhaust valve of the adjacent cylinder, or is emitted out via the exhaust trunk 310 directly.

The fourth cylinder 304 is at an expansion stroke and is in an intake state at this time. The inlet valve 305 is closed and the exhaust valve 308 is half open (or fully open). The piston moves left to take in via the exhaust manifold 309 the air emitted out by the adjacent cylinder. (Note: the half open state is to avoid the interference with the inlet valve. It may also be fully opened if there is no interference).

It can be seen that, during this period of time, all the exhaust valves are open. The first cylinder is at the inlet stroke and its inlet valve is also open to take in new air. It only takes in air but does not exhaust to make the exhaust manifold vacuum. The exhaust valve both takes in air and exhausts. Most air moves forward, or moves back to flow and exchange in the engine complementarily via the exhaust valve and the exhaust manifold with the intake and exhaust actions of the cylinders. Remained little amount of air is emitted out from the exhaust trunk directly. There is no back pressure in each stroke. Therefore, the retarding force is greatly decreased and the negative work is very low. Since the exchange of the air is implemented via only the exhaust valve and the exhaust manifold, the inlet valve and the inlet manifold do not participate in the exchange of the air, there is no air flowing reversely, which ensures the vacuum of the inlet manifold. (Note: in the circulation procedure, the original compression stroke emits out air and the original expansion stroke takes in air. There are no compression stroke and expansion stroke herein. Actually, it becomes a two-stroke procedure).

Figure 3B:
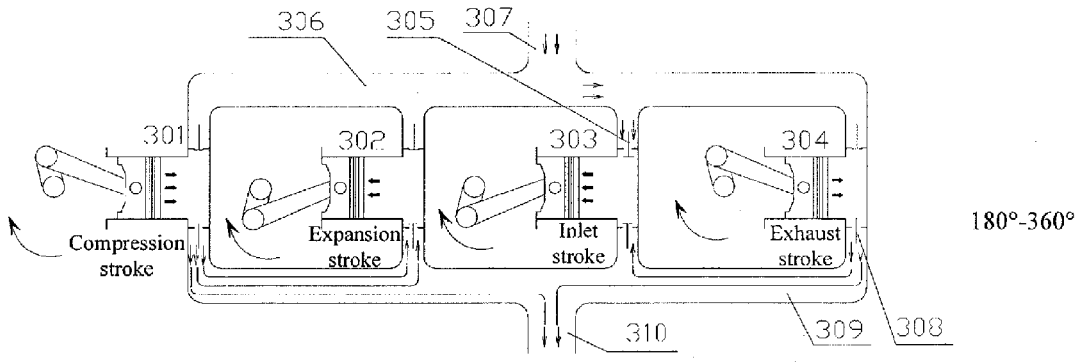
Figure 3C:
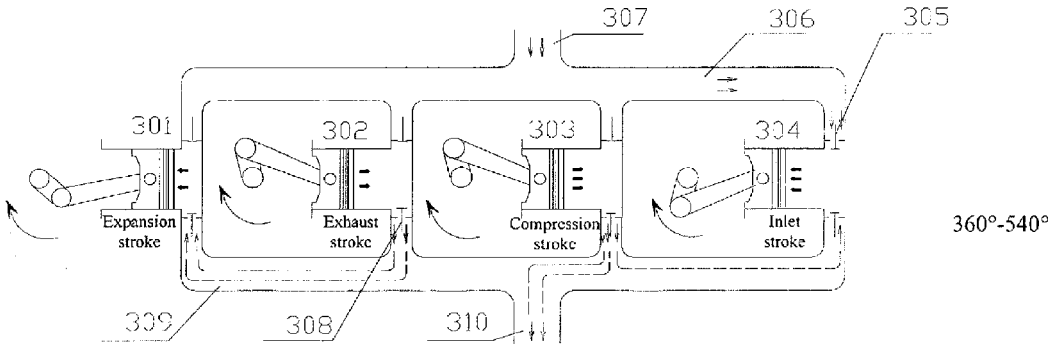
Figure 3D:
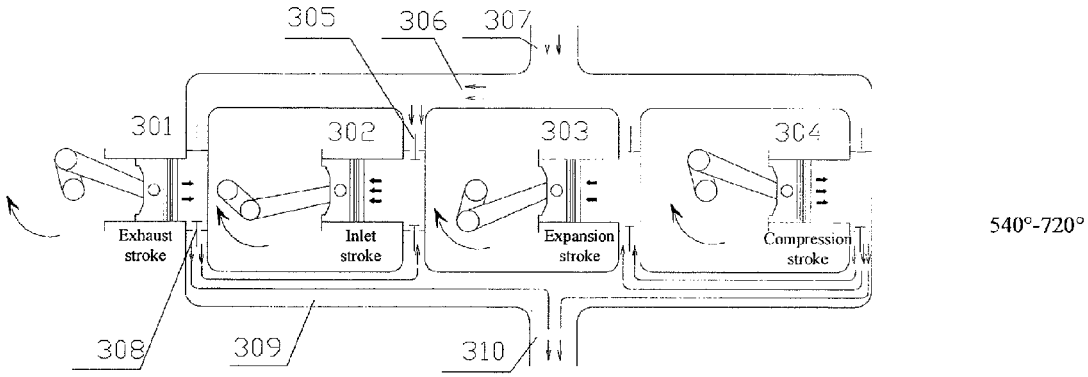

During the period when the crankshaft angle is 180°-360°, 360°-540° and 540°-720°, the circulation procedures are the same as that described above. The circulation procedures are as shown in FIG. 3*b* to FIG. 3*d*. Each period is able to effectively reduce pressure and retarding force, and reduce negative work. Since the exchange of the air is implemented via only the exhaust valve and the exhaust manifold, the inlet valve and the inlet manifold do not participate in the exchange of the air, there is no air flowing reversely, which ensures the vacuum of the inlet manifold, and has no effect to braking. The racing of the engine also does not affect the directional assistant power.

At the working condition c, when operated with reduced cylinder, the electronic control unit compels non-working cylinder to stop the fuel injection. The non-working cylinder realizes racing with reduced pressure following the above circulation procedure to reduce the retarding force. At the same time, the working cylinder works normally.

At the working condition a, the operations are well known and will not be described herein.

The detailed controlling procedure is as follows.

Still taking the manually startup at the working condition b as an example. When a fuel saving condition is met (e.g., when driving on a long downgrade road or the road condition is well for gliding with a relatively high speed), the driver retards the throttle and gives out a glide instruction (e.g., presses a gliding button), the electronic control unit automatically puts through a power supply to control and drive the actuator, and cuts off a power supply of a fuel injector of a corresponding cylinder to stop the fuel injection. When the crankshaft angle sensor delivers electronic signals when the cylinders are opened largest to the electronic control board in an order of 1-3-4-2, the electronic control board puts through electromagnetic valve winding of a valve locking controlling apparatus of the actuator in turn. The electromagnetic valves of the cylinders open the oil tunnel of hydraulic pressure valve locking apparatus in turn. The fuel with the high pressure drives the slider of the corresponding valve locking apparatus to insert, when the exhaust valve of each cylinder reaches a largest valve lift, in a ring groove of the valve lever to complete the locking. The exhaust valve is constantly half open to fully open, the cylinder is in an open and pressure reduced state. The engine races without fuel. The inlet valve opens and closes normally and the inlet manifold is vacuum. The vehicle glides without the retarding force of the engine. The direction and the braking are not affected. The dashboard displays normally, the dynamotor generates electricity normally to recycle the kinetic energy. This is maintained until the working condition is switched.

When the electronic control unit samples information such as braking, speeding-up, clutch, low-speed (<20 km/h) and fuel injection, an OR gate circuit of the electronic control unit is put through to cut off the power supply of the actuator at once. The power supply of the electromagnetic valve is cut off and the oil tunnel is closed to release pressure automatically. A resetting spring of a slider of the hydraulic pressure valve locking apparatus springs back. When the valve lever has the largest valve lift, the slider resets to realize unlocking. Meanwhile, the fuel injector is put through and injects fuel normally. The exhaust valve opens and closes normally. The engine goes back to normal operation at once.

Similarly, when the fuel saving condition is met and the speed decreases after the vehicle glides for a distance with a relatively high speed, if the speed-up footplate is stepped on, it will automatically switch to the normal working condition at once to speed up. When it reaches a relatively high speed, it will switch to the working condition b to glide without resistance. The procedure goes round and round. The engine works discontinuously in the best performance field.

At working condition c, a reduced-cylinder working condition (it is possible to pre-configure the first and the fourth cylinders as working cylinders or pre-configure the second and the third cylinders as working cylinders together or alternatively) is applicable for cruise and waiting red light. When the driver gives out a cruise instruction (cylinder reduction), after receiving the cylinder reduction instruction, the electronic control unit cuts off the fuel of the second and the third cylinder, locks a corresponding exhaust valve to open the cylinder and reduce pressure, and makes the first and the fourth cylinders work normally. The first and the fourth cylinders are selected in order to ensure that there is a cylinder does work at each 360° and ensure the stability of the operation. At this working condition, the fuel injection signal does not participate in the control of the switch to the normal working condition, which is used to ensure that the engine may operate stably when the first and the fourth cylinders work and the second and third cylinders do not. (The working principle of the second and the third cylinders is the same as that at the working condition b. The number of cylinders reduced may be configured randomly, such as 8-6, 8-4, 6-4, 6-2, 4-2, etc.).

Even if the energy-saving system fails, in the above technical solution, the locking apparatus may unlock by the force of the spring resetting. Thus, the normal operation of the engine will not be affected.

Considering driving habits and security, the energy-saving manner is manually controlled by the driver and the returning to the normal condition is controlled automatically. It may also be configured as full automatically.

Hereinafter, a four-cylinder engine is taken as an example to describe four detailed embodiments of the present invention. It is possible to select one of them according to different valve trains and remaining spaces of engines. Each actuator corresponds to at least one cylinder.

A First Embodiment

The electronic control unit 200*a* includes an electronic control board (or a single-chip computer) and an externally configured crankshaft angle sensor (Hall sensor), a stroke switch, a tact switch, a working condition indication lamp, etc. The electronic control board is equipped inside a box and is electronically coupled to a connector on the box. Each peripheral device is electronically coupled to a corresponding end of the connector. The box is installed at one side of an engine room. The crankshaft angle sensor is installed at the side of an exhaust camshaft and is electronically coupled to the connector on the box. A stroke switch (a magnetic sensitive switch or a reed switch) is installed respectively under each of a speeding-up footplate, a braking footplate and a clutch footplate. The stroke switches are electronically coupled to the connector on the box. Three tact switches are configured on a steering wheel. They are respectively a gliding switch, a cylinder reduction switch and a replace instruction switch and are all electronically coupled to the connector of the box. Under the dashboard, there configured six indication lamps (LED), in which two of them are used for gliding indication and reduced-cylinder working condition indication (by yellow). There is no indication at normal working condition. The other four lamps are used for valve open indication (by green). The indication lamps are electronically coupled to the electronic control unit. The fuel injection signal and the low-speed signal of the original vehicle ECU are electronically coupled to the connector of the box. Power supply of the fuel injector of the original vehicle interlocks with the electronic control board in association via the connector. The electronic control board is electronically coupled to the actuator.

Figure 4:
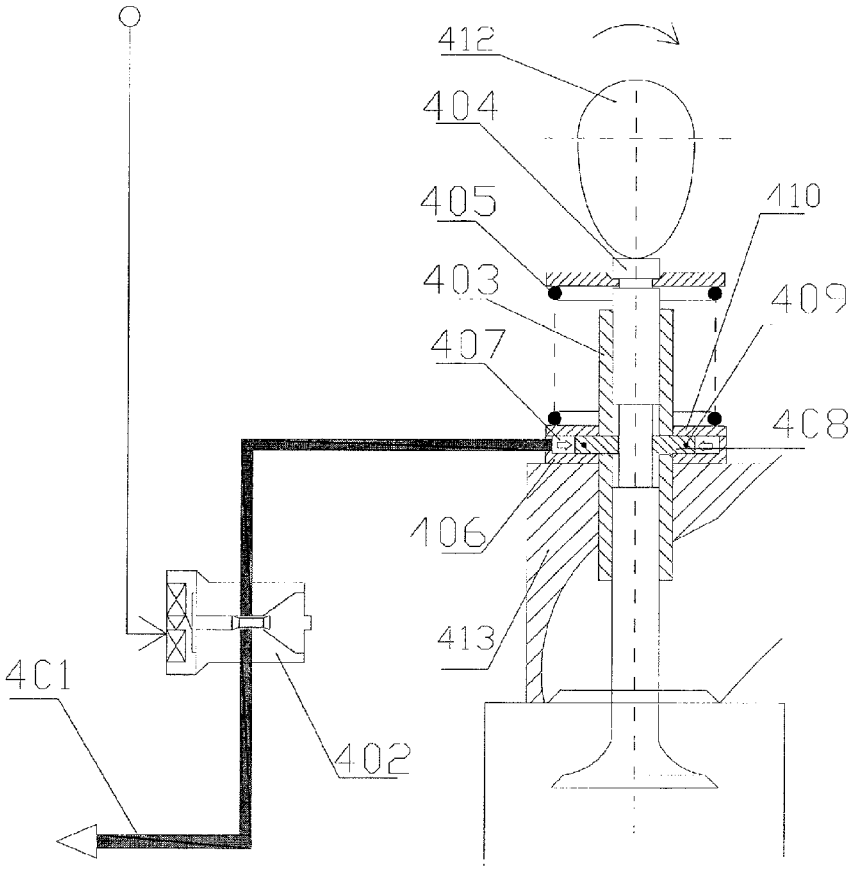
FIG. 4 is a schematic diagram illustrating a structure of the universal energy-saving system for multiple working conditions according to a first embodiment of the present invention.

The actuator is a valve lever locking apparatus as shown in FIG. 4, applicable for dual overhead camshaft engines. It includes: a fuel pipe 401, a high speed bi-pass electromagnetic valve 402 which is able to release pressure rapidly when power supply is cut off and keep the oil tunnel full, so as to ensure a reaction speed of the locking apparatus; a valve sleeving 403, on top of which there is a hole along a radial direction used as a gliding path of a slider of the locking apparatus; a valve lever 404 with a ring groove, on top of which there is a ring groove, the depth of the ring groove should be able to ensure the intensity of the valve lever and the reliability of the locking, the height of the ring groove should be able to meet a sliding distance from the half open state to the full open state, remained engine oil in the ring groove is able to absorb the impact force of the valve lever to the slider of the locking apparatus (a maximum linear velocity of the valve lever is 6 m/s); a valve spring 405, under an original spring coefficient, the length of the valve spring 405 shortens by 5 mm and the diameter of the valve spring 405 reduces 5 mm for facilitating the installation of the hydraulic pressure locking apparatus and the fuel pipe 401; a hydraulic pressure locking apparatus tank 406 with a fuel inlet, which is a steel-making hollow round can hydraulic pressure locking apparatus shell; a glide way 407, fixedly installed in the tank; a T-shape slider 408, installed in the glide way 407 and slides along the radial direction; a resetting spring wire 409; a top cover 410, sealed with the tank structure; a camshaft 412; and a cylinder cover 413.

During installation, firstly the cylinder cover 413 of the engine and the exhaust camshaft 412 are removed, and then an exhaust valve group is removed for stand-by. The electromagnetic valve 402 should be fixedly installed near a corresponding exhaust valve; the valve sleeving 403 is press installed in an inside hole of the locking apparatus 406 by taking the through-hole of the valve sleeving 403 upwards; the glide way 407 of the locking apparatus should align with the through-hole of the valve sleeving 403 and is press installed on the cylinder cover 413 together with the valve sleeving following required techniques. At this time, the T-shape slider 408, the resetting spring wire 409 and the top cover 410 are installed. The electromagnetic valve 402 is connected to a lubricating-oil tunnel of cam structure and the hydraulic pressure locking apparatus tank 406 with the fuel inlet. One electromagnetic valve drives two hydraulic pressure locking apparatuses. The valve lever (4) is inserted, the spring (5) and a spring upper seat are installed. The winding of the electromagnetic valve 402 is electronically coupled to the connector of the electronic control unit 200*a*. The modified components are installed back to the cylinder. And the camshaft 412 is installed according to required techniques finally.

The fuel with high pressure used by the actuator is from a camshaft lubricate system of the engine. Since the system has a security valve, an appropriate and stable fuel pressure may be ensured. Since the stroke of the locking apparatus is very small and the leakage is also very little, the fuel provided by the original lubricate system is able to meet the requirement of the locking apparatus.

After receiving a glide instruction, the electronic control unit automatically puts through the power supply of the actuator and cuts off the power supply of fuel injector of corresponding cylinder to stop the fuel injection. If the crankshaft angle sensor delivers electronic signals when the exhaust valve of each cylinder opens largest to the electronic control board in an order of 1-3-4-2, the electronic control board puts through the winding of each electromagnetic valve in turn. The electromagnetic valve of each cylinder opens the oil tunnel of the hydraulic pressure locking apparatus in turn. The fuel with the high pressure drives the slider of the corresponding valve locking apparatus, to insert ring groove of the valve lever in turn to complete and maintain the locking-up. During the locking period, the exhaust valve lever may slide along the axis direction only to a limited degree, to fit for the rotation of the exhaust cam. The exhaust valve is constantly half open to reduce pressure. The engine races without fuel. The inlet valve opens and closes normally. The inlet manifold is vacuum. The vehicle glides without the retarding force of the engine. The direction and braking of the vehicle are not affected. The dashboard displays normally. The dynamotor generates electricity normally and recycles kinetic energy until the working condition is switched. The detailed controlling procedure has been described in the above and will not be repeated herein.

A Second Embodiment

The electronic control unit is the same as that in the first embodiment.

Figure 5:
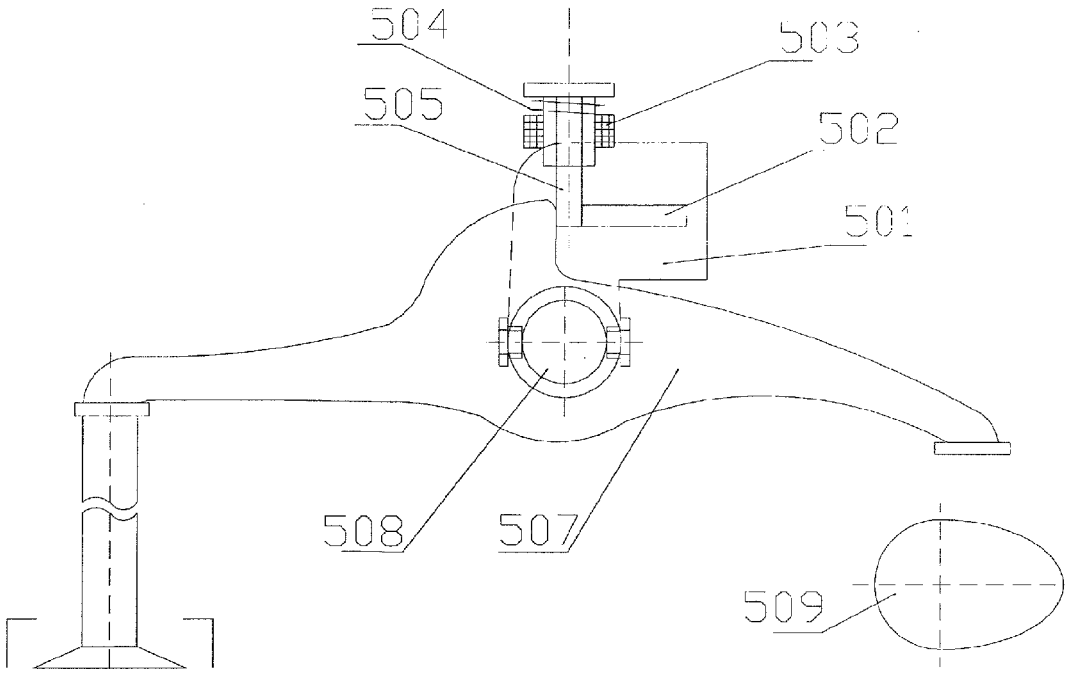
FIG. 5 is a schematic diagram illustrating a structure of the universal energy-saving system for multiple working conditions according to a second embodiment of the present invention.

The actuator is a rocker arm return restriction apparatus as shown in FIG. 5, applicable for middle or low camshaft rocker arm valve engines. It includes: a bracket 501, a baffle 502, an electromagnet 503, a return spring 504, a slider 505, a rocker arm 507 with a baffle, a rocker arm shaft 508 and a cam 509.

The baffle 502, the electromagnet 503, the return spring 504 and the slider 505 are installed on the bracket 501. The bracket 501 is fixed installed on the rocker arm shaft 508. Similar as the first embodiment, after receiving an instruction of the electronic control unit and when the cam 509 props up the rocker arm 507 to make the valve have a largest lift, the electromagnet 503 closes and pushes the slider 505 to block the baffle of the rocker arm 507 to restrict the return of the rocker arm 507, so as to achieve the objective of locking-up at the constant half open state. Thus, the objectives of cutting off fuel, racing with reduced pressure and prolonging gliding distance are realized. When the electronic control unit samples information such as braking, speeding-up, clutch, low-speed (<20 km/h), fuel injection and shift, it gives out a restore instruction at once. The electromagnet 503 opens, the slider 505 resets and unlocks relying on the return spring 504. The exhaust valve opens and closes normally and resumes the fuel injection. It comes back to the normal working condition. The controlling procedure is basically the same as the first embodiment and will not be described herein.

A Third Embodiment

The electronic control unit is the same as that in the first embodiment.

Figure 6:
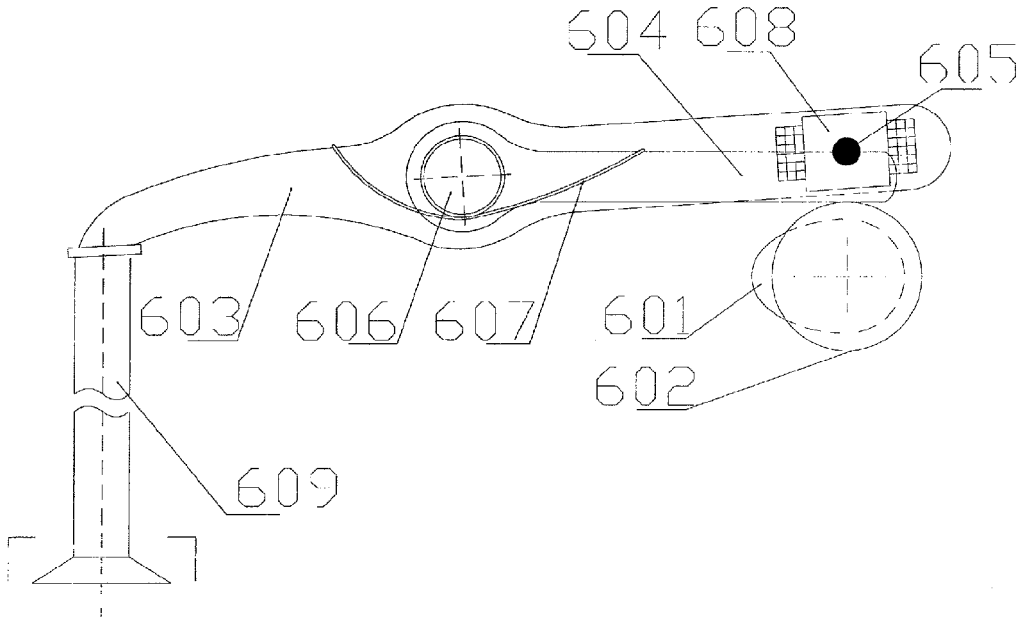
FIG. 6 is a schematic diagram illustrating a structure of the universal energy-saving system for multiple working conditions according to a third embodiment of the present invention.

The actuator is a rocker arm and active assistant arm apparatus as shown in FIG. 6, applicable for overhead camshaft rocker arm engines. A concentric ring 602 which is larger than a basic circle but smaller than a top outline of the cam is added to one side of the cam 601. A lockable active assistant arm 604 is added to the rocker arm 603. The active assistant arm 604 keeps to be jointed with the ring 602 under the function of a torsional spring 607 and is installed on a rocker arm shaft 606. An electromagnet 608 is installed on the rocker arm 603 and is used for controlling a limit pin. The limit pin 605 is able to restrict the angle of the active assistant arm 604 and restrict the stroke of the rocker arm by cooperating with the ring 602. Similarly as the first embodiment, after receiving an instruction of the electronic control unit, when the cam 601 props the rocker arm 603 to a largest lift, the electronic control unit sends a signal to control the close of the electromagnet 608 and pull the limit pin 605 to restrict the angle of the active assistant arm 604, so as to make the rocker arm 603 not joint with the cam 601 when the top of the cam descends, and make the rocker arm 603 pushes, together with the active assistant arm 604, the valve lever 609 to move between half open and full open states, so as to realize the action of constant half open of the exhaust valve. Thus, the objectives of cutting off fuel, racing with reduced pressure and prolonging the gliding distance are realized. When the electronic control unit samples information such as braking, speeding-up and shift, it gives out an instruction at once. The electromagnet opens, the limit pin 605 is pulled back by the return spring of the electromagnet. The active assistant arm 604 swings without load. The exhaust valve opens and closes normally. It comes back to the normal working condition. The controlling procedure is basically the same as that in the first embodiment and will not be described herein.

The Fourth Embodiment

The electronic control unit is the same as that in the first embodiment (but the designed actions may also be realized by omitting the crankshaft angle sensor).

Figure 8A:
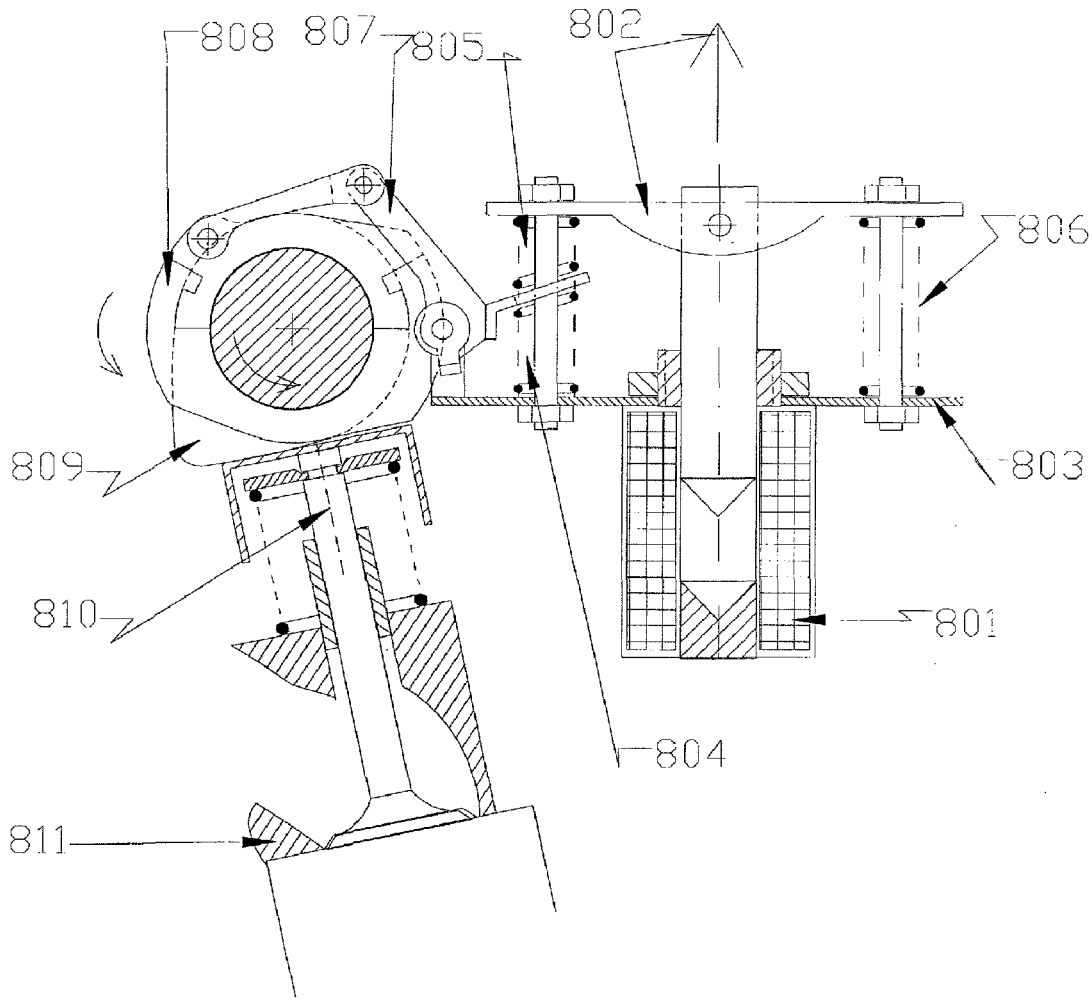
FIG. 8*a* and FIG. 8*b* are schematic diagrams illustrating structures of the universal energy-saving system for multiple working conditions according to a fourth embodiment of the present invention.
Figure 8B:
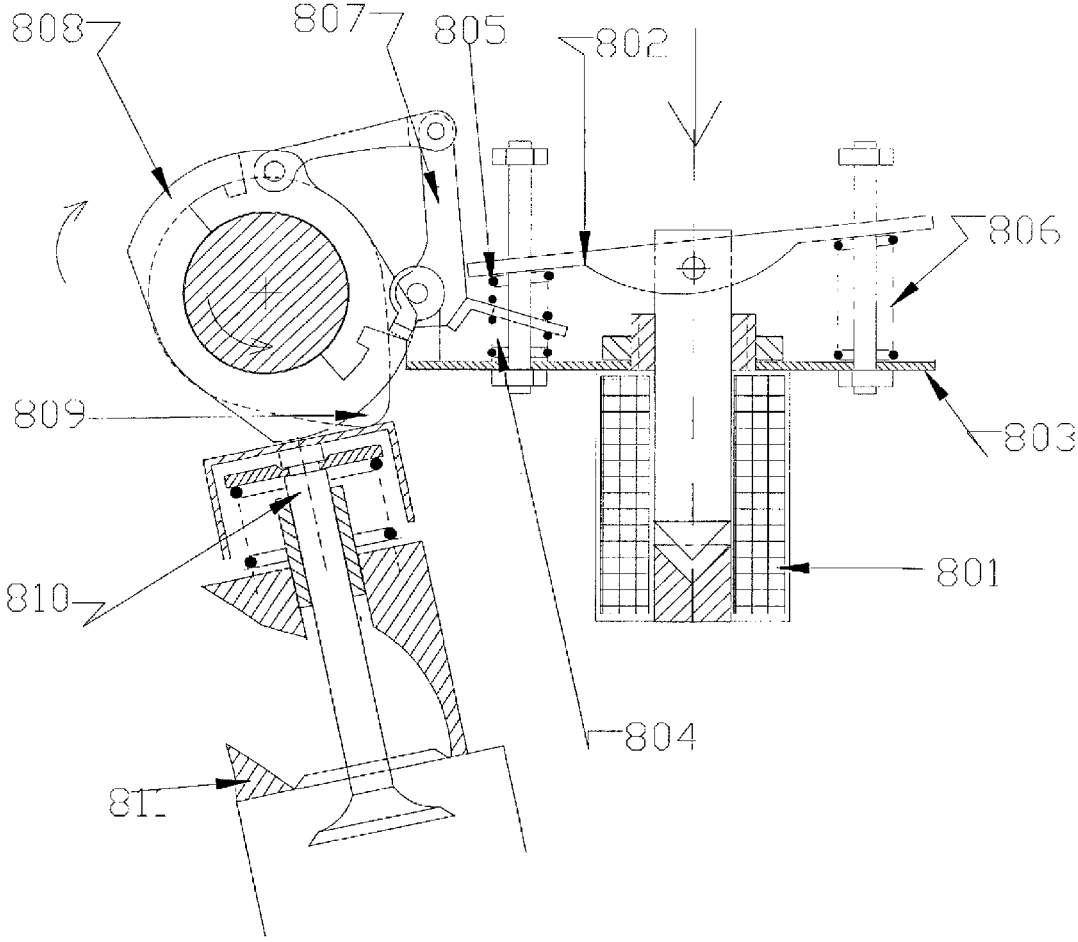

The actuator is a swing arm rod and activity limit cam as shown in FIG. 8*a* and FIG. 8*b*. The valve position limit apparatus is applicable for dual overhead camshaft engines and includes: a high speed mighty electromagnet 801, an armature 802, a combined bracket 803, a return spring 804, an energy storing spring 805, an assistant spring 806, a swing arm rod combination 807, a limit active cam 808, an original cam 809, a valve group 810 and a valve seat 811.

The high speed mighty electromagnet 801 is fixedly installed between two spark plugs. The combined bracket 803 is fixedly installed on the high speed mighty electromagnet 801. The swing arm rod combination 807 is hinged with the combined bracket 803 and is hinged with the limit active cam 808. The limit active cam 808 consists of two half mighty metal components which have mortise and tenon structures in an axis direction and are wedged with each other, which is installed on the non-camshaft seat side of the original cam 809 and cooperates with the camshaft dynamically. The mortise and tenon structure is adopted to facilitate the installation and ensure the accuracy. Same as the first embodiment, after the electronic control unit receives a pressure reduction instruction, the electromagnet 801 puts through the power supply and closes at once, pushes the armature 802 to move downwards, compresses the energy storing spring 805 distorted to store energy. When the original cam 809 rotates and starts to prop up the valve group 810, the armature 802 keeps on moving downwards. The energy storing spring 805 releases at the same time, to make the swing arm rod combination 807 pull the limit active cam 808 to return a certain angle until the electronic control unit receives a release instruction. At this time, the valve group 810 has been propped open by the original cam 809, and position of the valve group 810 has been restricted by the limit active cam 808, thus it cannot return to the sealing position of the valve seat 811 and can only move between the half open position and the full open position and keeps at the constant half open state. When the electronic control unit receives the release instruction, it instructs the electromagnet 801 to cut off the power supply. Under the cooperation of a revolving friction force between the camshaft and the return spring 804, as well as the revolving friction force between the camshaft and the assistant spring 806, the armature 802, the swing arm rod combination 807 and the limit active cam 808 reset. The valve group releases from the constant half open state and resumes to normal working state.

The advantage of this technical solution is that: the actuator permits a large tolerance. It allows time inaccuracy of the action cooperation of the original cam 809 and the limit active cam 808. Therefore, the crankshaft angle sensor may be omitted. The structure is simplified and a better practicability is achieved. Moreover, it is possible to use one electromagnet to drive two groups of valve with different close phases of two adjacent cylinders, i.e. one drive two, which effectively solves the problem that there is little idle space in the original engine and it is hard to add component. It requires very little modification to the original engine and is good for reconstruction of old vehicles.

Similarly, all of the above four embodiments can operate under the working conditions a, b and c, and can meet the structure requirements of most engines. To sum up, whichever structure is adopted, if only the circulation mode shown in FIG. 3 and the valve movement curve shown in FIG. 7 can be realized, to make the inlet valve operate normally and make the exhaust valve operate in constant half open state or in reduced pressure and cylinder open state and cut off the fuel, the energy-saving effect can be achieved. It is also possible to perform lock or release operation to the inlet valve or perform the lock or release operation to both the inlet valve and the exhaust valve at the same time. It is also possible to adopt non-effort-saving actuator, open the cylinder and reduce pressure. The objective of saving fuel under multiple working conditions can still be achieved. But the complexity of the structure, the cost, practicability and other overall effect are inferior to the previous technical solution and therefore is not preferred. The system is not applicable for engineering mechanism and shipping.

It can be seen from the above embodiments that, the universal energy-saving system for multiple working conditions realizes the multiple working conditions work of the engine. Different working conditions correspond to different road conditions, so as to fit for three conditions most frequently emerge during running of the vehicle. A, normal working condition: each performance parameter of the original vehicle does not change B, racing and gliding working condition: all fuel is cut off, the exhaust valve is constantly half open or constantly half open at the compression stroke, expansion stroke and exhaust stroke. The retarding force is the smallest, the vehicle races and glides the farthest. C, reduced cylinder working condition with middle or little load: fuels of non-working cylinders are cut off, the exhaust valve is constantly half open to reduce the retarding force, which not only reduces the fuel of non-working cylinders but also reduces load of working cylinders. Therefore, the objectives of prolonging gliding distance without fuel at working condition b as well as reducing fuel and eliminating retarding force at working condition c are realized. The deficiencies of the four-stroke engines are overcome, the vacuum of inlet manifold is not affected and the driving security is ensured. It is possible to switch between the working conditions according to practical road conditions manually or automatically. When the engine does work, fuel is used; otherwise, no fuel is used and none or less negative work is done, which solves the problem from the point of view of reducing the waste of the kinetic energy, overcomes the deficiency of the prior art which only emphasizes the increasing of efficiency but ignores the reducing of waste, achieves an ideal fuel-saving and emission-reducing effect. With respect to different driving habits, the fuel saving ratio may achieve 15-40%. Through saving fuel, the emission reduction is realized. The emission reduction may achieve 15-40% correspondingly.

The advantage of the universal energy-saving system for multiple working conditions is: when racing and gliding (or for non-working cylinders when cylinders are reduced), only the cylinder is opened to reduce pressure and to eliminate retarding force, no fuel is used. The spark plug may be cleaned without stopping the ignition. The dynamotor generates electricity normally and recycles power. All dashboards display normally. Lubricating and cooling are normal. Air-conditioning is normal. The direction and braking are not affected. The engine may work discontinuously at the best performance field. The fuel saving and emission reduction effect is remarkable. Since the rotating speed of the engine, when racing and gliding, corresponds to the speed of the vehicle, in most cases, the rotating speed of the engine will be approximately the best performance field. Therefore, it will be smoother when switching to speed up, the tweak force is big and the speed is increased fast. The technical solution of the system includes both a scientific controlling method and a reasonable actuator, the volume is small, the cost is low, complete and definite, has a high compatibility and is easy to be implemented. It is applicable for reconstructing old vehicles and equipping new vehicles. It has a high reliability and a wide application range, applicable for equipping vehicles with four-stroke engines with various kinds of fuels and different numbers of cylinders, especially for mixed power vehicles and is most applicable for vehicles with electromagnetic valve engines. Although it is not advanced and sophisticated, it is economical and practicable. Effect can be got instantly by little cost. Due to its outstanding fuel economical characteristic, great selling profits will be brought to vehicle distributors.

The invention claimed is:

1. A universal energy-saving system for multiple working conditions, comprising: an electronic control unit, an actuator and an engine;

wherein the engine is a four-stroke engine with multiple cylinders and comprises: cylinders, a piston, an inlet valve, an exhaust valve, a fuel injector, an inlet manifold, an exhaust manifold and an exhaust trunk;

the electronic control unit is adapted to drive the actuator to control the inlet valve and the exhaust valve of the engine to move according to a pre-defined circulation mode or a regular mode, and adapted to control on and off of a power supply of the fuel injector, so as to greatly reduce, when the vehicle glides and races with reduced pressure and no fuel, resistance of the engine to get a farthest gliding distance, and to use, when the vehicle operates with reduced cylinders, less fuel and has a smallest resistance of non-working cylinder, and to maintain power at a normal working condition, to achieve an objective of energy-saving and emission reduction;

wherein the circulation mode comprises: during four time periods of the crankshaft angle 0°-180°, 180°-360°, 360°-540° and 540°-720°, in each time period, there is an exhaust valve of each cylinder is at an open or part open state, the inlet valve only opens at an inlet stroke, the inlet valve only takes in air but not exhausts to make the inlet manifold vacuum, the exhaust valve both takes in air and exhausts, part of the air moves forward, or moves back to flow and exchange in the engine complementarily via the exhaust valve and the exhaust manifold with the intake and exhaust actions of each cylinder, remained air is directly emitted out from the exhaust trunk, to eliminate a compression stroke and an expansion stroke, to become a two-stroke procedure, and to eliminate a resistance when the engine races without fuel;

wherein the actuator comprises: a position limit apparatus which is able to restrict, under control of the electronic control unit, the exhaust valve of the engine of the vehicle at a regular movement state or at a non-close state;

at the non-close state, the exhaust valve moves according to a constant half open movement curve of the exhaust valve:

during the four time periods of the crankshaft angle 0°-180°, 180°-360°, 360°-540° and 540°-720°, the exhaust valve corresponding to the exhaust stroke moves to a largest lift from a constant half open state and then moves back to the constant half open state, exhaust valves corresponding to the intake stoke, the compression stoke and the expansion stroke keep in the constant half open state.

2. The universal energy-saving system for multiple working conditions of claim 1, further comprising: an externally configured crankshaft angle sensor, stroke switches respectively installed under a speeding-up footplate, a braking footplate and a clutch footplate of the vehicle, a gliding switch, a cylinder reduction switch and a replace instruction switch installed on a steering wheel of the vehicle, and a working condition indication lamp configured on a dashboard;

the electronic control unit comprises an electronic control board, input signals of the electronic control board comprise: a signal of the externally configured crankshaft angle sensor, a fuel injection signal and a low-speed signal of a vehicle ECU, speed-up signal, a braking signal and a clutch signal generated by stroke switches installed under the speeding-up footplate, the braking footplate and the clutch footplate, input signals of the gliding switch, the cylinder reduction switch and the replace instruction switch on the steering plate; and output signals of the electronic control board comprise: a control signal of the working condition indication lamp on the dashboard, and a fuel injection signal used for controlling the fuel injector of the vehicle.

3. The universal energy-saving system for multiple working conditions of claim 1, wherein the engine is a dual overhead camshaft engine;

the actuator comprises a valve lever which is able to control the open and close degree of the exhaust valve under propping of a camshaft, wherein the valve lever has a ring groove;

the position limit apparatus is a slider whose front end is able to insert into the ring groove;

the length of the ring groove equals to a sliding distance of the exhaust valve under the non-close state; and when the camshaft props up the valve lever to a largest lift, the slider is able to restrict, under control of the electronic control unit, the exhaust valve at the non-close state by inserting the front end into the ring groove.

4. The universal energy-saving system for multiple working conditions of claim 1, wherein the engine is a middle or low camshaft rocker arm valve engine;

the actuator comprises a rocker arm which is able to control the open and close degree of the exhaust valve under the propping of a cam, wherein the rocker arm comprises a baffle;

the position limit apparatus is a slider whose front end is able to be extended to touch the baffle; and when the camshaft props up the valve lever to a largest lift, the slider is able to restrict, under control of the electronic control unit, the exhaust valve at the non-close state by touching the baffle and restricting movement of the rocker arm.

5. The universal energy-saving system for multiple working conditions of claim 1, wherein the engine is an overhead camshaft rocker arm engine;

the actuator comprises: a rocker arm which is able to control the open and close degree of the exhaust valve under the propping of a cam; a concentric ring configured at one side of the cam, and an active assistant arm configured on the rocker arm;

the radius of the concentric ring is larger than a basic ring of the cam but is smaller than a top outline of the cam, the active assistant arm is able to joint with the concentric ring;

the position limit apparatus is a limit pin which is able to restrict angel of the active assistant arm; and when the rocker arm opens the exhaust valve to the largest lift, the active assistant arm is able to restrict, under control of the electronic control unit, movement of the rocker arm by touching the concentric ring and the limit pin to restrict the exhaust valve at the non-close state.

6. The universal energy-saving system for multiple working conditions of claim 1, wherein the engine is a dual overhead camshaft engine;

the actuator comprises: a bracket fixedly installed between two adjacent cylinders of the engine, a swing arm rod combination hinged with the bracket, and a cam which controls the open and close degree of the exhaust valve by propping the valve lever;

the position limit apparatus is a position limit active cam installed at a non-camshaft seat side of the cam, wherein the position limit active cam is hinged with the swing arm rod combination and cooperates with the cam by moving axis; and the position limit active cam is able to restrict, under control of the electronic control unit, the exhaust valve at the non-close state by propping up the valve lever.

7. The universal energy-saving system for multiple working conditions of claim 6, wherein the swing arm rod combination of two adjacent cylinders are both hinged with the bracket.

8. The universal energy-saving system for multiple working conditions of claim 6, wherein the position limit active cam comprises two symmetrical components which mesh with each other by a mortise and tenon structure in an axis direction.

9. The universal energy-saving system for multiple working conditions of claim 3, wherein the open and close degree of the exhaust valve is configured in advance.

10. The universal energy-saving system for multiple working conditions of claim 1, wherein the universal energy-saving system for multiple working conditions does not affect normal operation of the engine, and is applicable for modification of vehicles with four-stroke engines using various kinds of fuels and having multiple cylinders, and is applicable for equipment of new vehicles with four-stroke engines using various kinds of fuels and having multiple cylinders.

* * * * *